US005465577A

United States Patent [19]

Schulte-Werning

[11] Patent Number: 5,465,577

[45] Date of Patent: Nov. 14, 1995

[54] GAS TURBINE COMBUSTION CHAMBER

[75] Inventor: Burkhard Schulte-Werning, Basel, Switzerland

[73] Assignee: Asea Brown Boveri Ltd., Baden, Switzerland

[21] Appl. No.: 339,292

[22] Filed: Nov. 10, 1994

Related U.S. Application Data

[63] Continuation of Ser. No. 159,555, Dec 1, 1993, abandoned.

[30] Foreign Application Priority Data

Dec. 17, 1992 [DE] Germany ..... 42 42 650.2

[51] Int. Cl.[6] ..... F02C 1/00; F02G 3/00

[52] U.S. Cl. ..... 60/722; 60/752; 60/39.36

[58] Field of Search ..... 60/722, 752, 39.36, 60/39.37

[56] References Cited

U.S. PATENT DOCUMENTS

| | | | |
|---|---|---|---|
| 2,685,421 | 8/1954 | Klose | 60/39.36 |
| 2,807,139 | 9/1957 | Jackson | 60/39.36 |
| 3,372,542 | 3/1968 | Sevetz | 60/39.36 |
| 3,620,012 | 11/1971 | Wilde | 60/39.36 |
| 3,783,616 | 1/1974 | Norman et al. | 60/204 |
| 4,146,357 | 3/1979 | Ward et al. | 431/158 |
| 4,192,139 | 3/1980 | Buchheim | 60/746 |
| 4,947,641 | 8/1990 | Rodgers | 60/39.142 |

FOREIGN PATENT DOCUMENTS

| | | | |
|---|---|---|---|
| 1046954 | 12/1958 | Germany | 60/722 |
| 2632079 | 2/1977 | Germany . | |
| 2737773C2 | 10/1982 | Germany . | |
| 9207469 U | 9/1992 | Germany . | |

*Primary Examiner*—Richard A. Bertsch
*Assistant Examiner*—Howard R. Richman
*Attorney, Agent, or Firm*—Burns, Doane, Swecker & Mathis

[57] ABSTRACT

In a gas turbine combustion chamber, which consists of an inlet zone (1) with injection, an ignition delay zone (2), a reaction zone (3), a burn-out zone (4) and a transition zone (5) to the turbine, the reaction zone (3) has a cross-section which increases in such a way that the gas dynamics of the combustion process can take place at constant pressure or constant Mach number. By this means, the total pressure loss and the combustion chamber length necessary for the combustion are reduced and this is reflected in an improvement to the efficiency and the output.

6 Claims, 1 Drawing Sheet

GAS TURBINE COMBUSTION CHAMBER

This application is a continuation of application Ser. No. 08/159,555, filed Dec. 1, 1993, now abandoned.

BACKGROUND OF THE INVENTION

1. Field of the Invention

The invention relates to a gas turbine combustion chamber.

2. Discussion of Background

It is known that the hot gas accelerates in combustion chambers because of the energy supply and the rising temperature in the flow direction resulting from combustion. Even in the absence of friction, the result of this is a total pressure loss whose level depends on the ratio of the outlet temperature to the inlet temperature. This total pressure loss has an effect on the process and is reflected in a reduction of the efficiency and power of the installation.

The gas dynamics of the heat supply (combustion) in a combustion chamber can be of various types. The special case of combustion at constant cross-section is of principal importance in practice.

If the combustion is effected at constant cross-section, the total pressure loss is relatively large. In consequence, the efficiency and the output of the combustion chamber are low and the additional acceleration of the hot gas leads to a relatively long combustion chamber for a given time constant of the chemical conversion.

SUMMARY OF THE INVENTION

Accordingly, one object of the invention is to avoid all these disadvantages and to create a gas turbine combustion chamber in which the total pressure-loss and the combustion chamber length are simultaneously small.

In accordance with the invention, this is achieved in a gas turbine combustion chamber consisting of an inlet zone with injection, an ignition delay zone, a reaction zone, a burn-out zone and a transition zone to the turbine, wherein the reaction zone has a cross-section which increases in such a way that the gas dynamics of the combustion process can take place at constant pressure or at constant Mach number.

The advantages of the invention consist in the fact that, because of the combustion at constant Mach number or at constant pressure, only a small total pressure loss is caused and the combustion chamber length is reduced. In consequence, the efficiency and the output of the combustion chamber are substantially better than those of the prior art.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
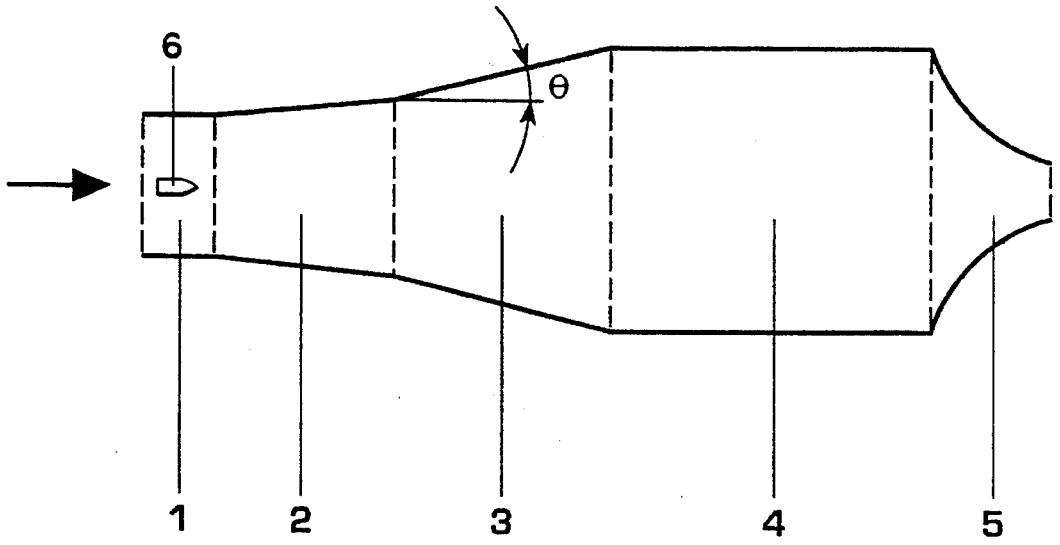
FIG. 1 shows a longitudinal section of the combustion chamber for p=const.

Referring now to the drawings, wherein like reference numerals designate identical or corresponding parts throughout the several views, in which two embodiment examples of the invention are represented by means of a gas turbine combustion chamber, in which only the elements essential to understanding the invention are represented and in which the flow direction of the working medium is indicated by arrows, FIG. 1 diagrammatically represents a combustion chamber according to the invention. The ratio of the combustion chamber height at the beginning of the reaction zone 3 to the length of the reaction zone 3 is approximately unity.

This gives the following values (as shown in the table) for various cases, where $p_o$ is the total pressure, where the index 1 refers in each case to the values at the inlet to the reaction zone 3 and where the index 2 refers in each case to the values at the outlet from the reaction zone 3.

| Case | $\frac{p_1}{p_{o1}}$ | $Ma_1$ | $\frac{p_2}{p_{o1}}$ | $\frac{u_2}{u_1}$ | $Ma_2$ | $\frac{A_2}{A_1}$ | θ in ° | $\left\lvert\frac{\Delta p_o}{p_{o1}}\right\rvert$ |
|---|---|---|---|---|---|---|---|---|
| A = const | 0.985 | 0.15 | 0.969 | 1.456 | 0.182 | 1.00 | 0 | 0.769 |
| Ma = const | 0.985 | 0.15 | 0.979 | 1.175 | 0.150 | 1.21 | 6 | 0.583 |
| p = const | 0.985 | 0.15 | 0.985 | 1.000 | 0.124 | 1.45 | 12 | 0.485 |

In this example, the duct semi-flare angle Θ can be taken into account without difficulty in the design of the combustion chamber.

As can be seen from the table, constant pressure combustion, for which the flow velocity u is also constant, is the most favorable. Constant pressure combustion has the advantage that it reduces the total pressure loss, the combustion chamber length and the pressure difference over the combustion chamber wall to a minimum. If, for example, constant pressure combustion cannot be effected in the design for geometrical reasons (the duct flare angle in the reaction zone 3 is relatively large), combustion at constant Mach number can be used as a basis for optimizing the combustion chamber because, compared with the prior art (A=const), this likewise produces a further substantial reduction in the total pressure loss and the hot gas acceleration, due to the supply of energy.

FIG. 1 shows a combustion chamber according to a first embodiment of the invention. After the inlet a fuel injector 6 is positioned in the inlet zone 1 to introduce a fuel into the combustion chamber flow with injection (inlet zone 1), the ignition delay zone 2 is designed as a conventional diffuser. In the reaction zone 3, the increase in cross-section according to the invention takes place to such an extent that the combustion takes place at constant pressure. This is followed by the burn-out zone 4 which has a constant (maximum) cross-section. The transition zone 5 to the turbine is designed with a conventional nozzle geometry.

Figure 2:
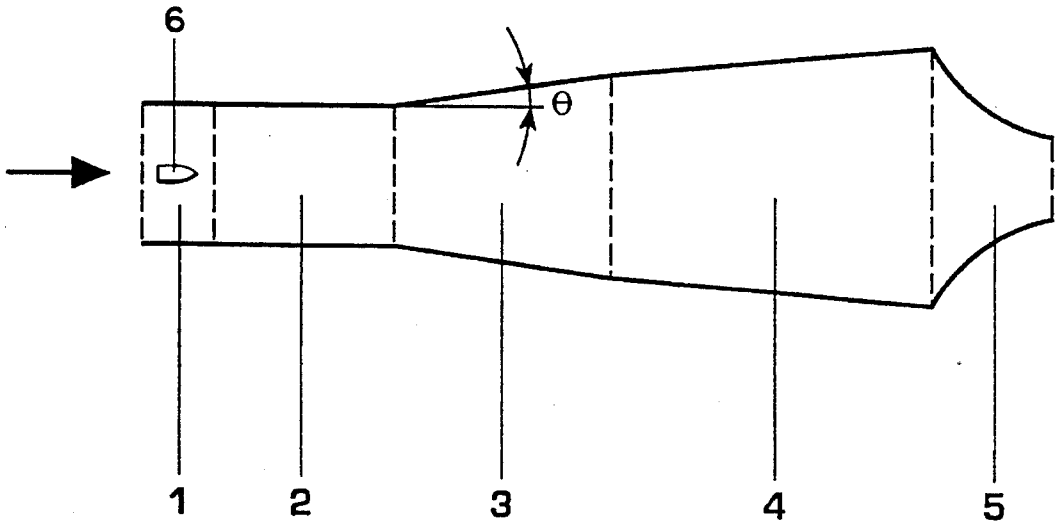
FIG. 2 shows a longitudinal section of the combustion chamber for Ma=const.

A different embodiment example of the invention is represented diagrammatically in FIG. 2, using the longitudinal section of a combustion chamber. The combustion chamber is laid out in such a way that a constant Mach number is ensured in the reaction zone 3 because, in this combustion process, a suitable increase in cross-section is superimposed on the heat supply due to the chemical reaction. The duct semiflare angle Θ is smaller in this case than in the first embodiment example. The inlet zone 1, the ignition delay zone 2 and the burn-out zone 4 can, of course, be designed in a similar manner to Embodiment Example 1 or can also have different geometrical shapes, as represented in a variant in FIG. 2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A gas turbine combustion chamber of the type having spontaneous combustion of a fuel and air mixture, comprising:

an inlet zone for receiving combustion air into the combustion chamber, a wall of the combustion chamber bounding the inlet zone being shaped so that the inlet zone has a predetermined cross-sectional area perpendicular to a longitudinal axis;

means for injecting a fuel in the inlet zone;

a reaction zone downstream of the inlet zone for combustion having means for maintaining a static pressure of a combusting fuel and air mixture that is constant throughout the reaction zone during combustion, a wall bounding the reaction zone diverging outwardly from the longitudinal axis of the combustion chamber at a predetermined angle for a predetermined length of the combustion chamber so that a cross-sectional area of the reaction zone increases in a flow direction over the predetermined length;

a burnout zone downstream of the reaction zone; and a transition zone downstream of the burnout zone to direct the combustion gases to the turbine.

2. The gas turbine combustion chamber as claimed in claim 1, wherein the predetermined angle of the wall in the reaction zone is 12 degrees.

3. The gas turbine combustion chamber as claimed in claim 1, wherein the transition zone includes a nozzle to accelerate the combustion gas before entry into the turbine.

4. A gas turbine combustion chamber of the type having spontaneous combustion of a fuel and air mixture, comprising:

an inlet zone for receiving combustion air into the combustion chamber, a wall of the combustion chamber bounding the inlet zone being shaped so that the inlet zone has a predetermined cross-sectional area perpendicular to a longitudinal axis;

means for injecting a fuel in the inlet zone; and a reaction zone downstream of the inlet zone for combustion of a fuel and combustion air mixture having means for maintaining a constant Mach number of combustion gases in the reaction zone, wherein a wall bounding the reaction zone diverges outwardly from a longitudinal axis of the combustion chamber at a predetermined angle for a predetermined length of the combustion chamber.

5. The gas turbine combustion chamber as claimed in claim 4, wherein the predetermined angle of the wall in the reaction zone is 6 degrees.

6. A gas turbine combustion chamber of the type having spontaneous combustion of a fuel and air mixture comprising:

an inlet zone having means for injection of a fuel into a combustion air flow;

an ignition delay zone downstream of the inlet zone in which the fuel mixes with the combustion air;

a reaction zone downstream of the ignition delay zone in which the fuel and air mixture combusts having means for maintaining a static pressure of the combusting fuel and air mixture constant throughout the reaction zone during combustion, wherein the reaction zone is shaped to have a cross-section that increases in the flow direction over a predetermined axial length of the combustion chamber;

a burnout zone downstream of the reaction zone; and a transition zone downstream of the burnout zone.

* * * * *